United States Patent [19]

Riezler et al.

[11] Patent Number: 4,919,172

[45] Date of Patent: Apr. 24, 1990

[54] METHOD AND APPARATUS FOR PLYING A WEFT THREAD DIRECTLY IN AN AIR NOZZLE LOOM

[75] Inventors: Rudolf Riezler, Nonenhorn; Adnan Wahhoud, Lindau-Bodolz, both of Fed. Rep. of Germany

[73] Assignee: Lindauer Dornier Gesellschaft mbH, Lindau, Fed. Rep. of Germany

[21] Appl. No.: 335,119

[22] Filed: Apr. 7, 1989

[30] Foreign Application Priority Data

Apr. 19, 1988 [DE] Fed. Rep. of Germany ..... 3813060

[51] Int. Cl.[5] ..... D03D 47/30; D03D 47/34

[52] U.S. Cl. ..... 139/435.1; 139/450; 139/452

[58] Field of Search ..... 139/450, 435, 452, 116; 57/80, 81

[56] References Cited

U.S. PATENT DOCUMENTS 3,811,261 5/1974 Felix ..... 57/81

4,256,148 3/1982 Scharling ..... 139/450

*Primary Examiner*—Henry S. Jaudon

*Attorney, Agent, or Firm*—W. G. Fasse; D. H. Kane, Jr.

[57] ABSTRACT

The weft thread or weft threads in an air nozzle loom are plied into multi-strand weft threads directly in the loom. For this purpose one or several plying devices are arranged directly in the loom between a plurality of weft thread strand supply spools or cross-wound bobbins and the multi-ply weft thread insertion nozzle.

3 Claims, 1 Drawing Sheet

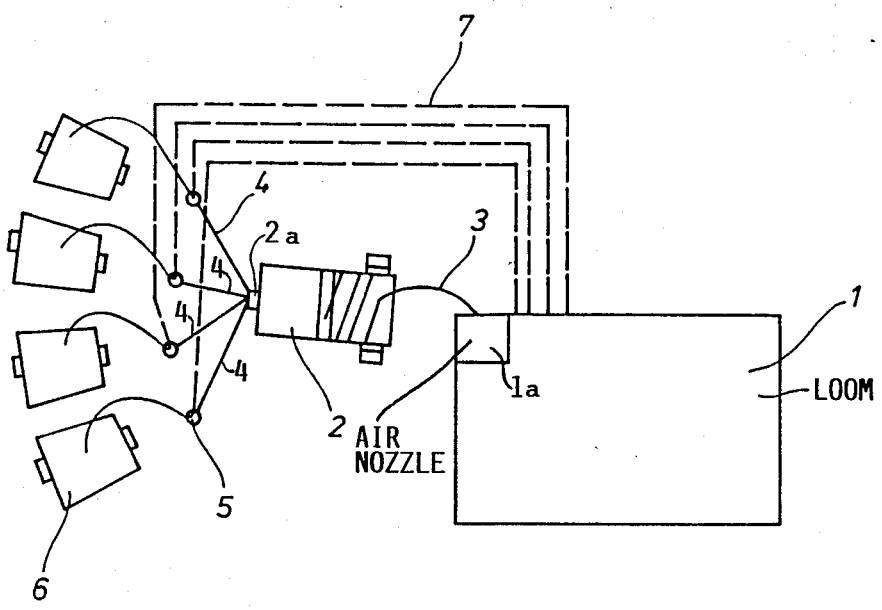
7
4
2a
3
4
4
4
1
1a
LOOM
2
AIR
NOZZLE
5
6

METHOD AND APPARATUS FOR PLYING A WEFT THREAD DIRECTLY IN AN AIR NOZZLE LOOM

FIELD OF THE INVENTION

The invention relates to a method and apparatus for plying one or more weft threads directly in an air nozzle loom. The individual strands for forming a multi-ply weft thread or threads are pulled off from a plurality of cross-wound bobbins or spools. The so-formed weft thread or threads can be of the normal or of the twisted type.

BACKGROUND INFORMATION

It has been known heretofore to prepare weft threads on a separate plying apparatus outside of a loom including an air nozzle weft thread inserting loom, if it was desired to use weft threads having multi-ply of the normal or twisted type. Providing a plying apparatus outside of the loom increases the machine costs substantially and makes the operational procedures more complicated because it is necessary to transport the bobbins or spools carrying the multi-ply weft threads from the plying apparatus to the loom.

OBJECTS OF THE INVENTION

In view of the above it is the aim of the invention to achieve the following objects singly or in combination:

to avoid the problems of the prior art by producing the multi-ply yarn directly on the air nozzle loom;

to construct the plying apparatus so that it may be located directly between the yarn supply spools or bobbins and the weft thread insertion air nozzle; and to use as a plying apparatus a conventional weft thread storage device which plies a plurality of weft thread strands coming from different bobbins into a multi-ply weft thread.

SUMMARY OF THE INVENTION

According to the invention the plying of individual strands into a multi-ply weft thread or threads takes place directly in the air nozzle loom, preferably between the strand supply bobbins and the weft thread inserting air nozzle. Preferably, the plying apparatus or device is a conventional weft thread storage drum. The individual strands coming from the bobbins may be normal untwisted strands or they may be twisted strands. Further, the strands may be of any conventional type such as weaving fibers, filaments, or the like. The strands become the plies.

According to the method of the invention the single strands are supplied to the weft thread inserting air nozzle through a plying device, preferably in the form of a weft thread storage means such as a storing drum which meters out correct lengths of weft threads for the insertion through the air nozzle.

BRIEF DESCRIPTION OF THE DRAWINGS

In order that the invention may be clearly understood, it will now be described, by way of example, with reference to the accompanying single FIGURE illustrating schematically an air nozzle loom equipped with a plying device according to the invention.

DETAILED DESCRIPTION OF A PREFERRED EXAMPLE EMBODIMENT AND OF THE BEST MODE OF THE INVENTION

The FIGURE shows schematically a loom 1 having a weft thread inserting nozzle 1*a* of conventional construction. According to the invention a plying device 2 in the form of a weft thread storage, such as a storing drum, is arranged between the air nozzle 1*a* and a plurality of strand supplying bobbins or spools 6 of conventional construction. Preferably, each strand is passed through a strand guide and sensor 5 also of conventional construction to ascertain whether a defect is present with regard to any one of the plurality of individual strands. Thus, four strand guide and sensors 5 are provided, one for each strand 4. Each strand guide and sensor element 5 provides individually a defect signal when the respective strand 4 should have such a defect, for example, when it ripped. The respective signals are supplied through signal conductors 7 to the conventional control system of the loom 1.

The multi-ply yarn 3 passes directly from the plying and storage device 2 to the air nozzle 1*a*. The plying and storage device 2 is normally equipped with means for measuring the length of the multi-ply yarn 3 that is metered out to the nozzle. Such metering devices are also conventional.

In operating the present apparatus an individual weft thread strands are not directly supplied to the air nozzle. Rather, the individual strands 4 are passed through the strand guide sensor elements 5 and then through the plying and storage device 2 which forms the multi-ply thread 3 directly upstream of the air nozzle 1*a* as viewed in the thread advance direction. If a breakage, for example should be detected in any of the strands 4 by the respective strand guide and sensor element 5, a respective control signal through the corresponding conductor 7 will cause the stopping of the loom.

The plying and storing device 2 is of conventional construction and comprises a strand guide element 2*a* which is bent at right angles to the longitudinal axis of the device 2 and which winds the strands onto a stationary drum storage. The output end of the storage drum leads directly into the weft thread insertion element of the loom, namely the main nozzle 1*a*. As mentioned, the storage device 2 meters an exact length of multi-ply weft thread for supplying to the nozzle which pulls off the required length from the drum of the device 2. Depending on the type of plying and storage device 2 used, the yarn 3 will be either untwisted, or twisted. In the examples shown the device 2 arranges the individual strands 4 in parallel to one another without twisting them to form the multi-ply yarn 3.

Rather than using only one plying and storing device 2, a plurality of such devices could be arranged as taught by the invention, whereby each such device would cooperate with a plurality of strand supply spools or bobbins for the intended plying operation. In the embodiment which employs a plurality of plying and storage devices 2, the respective weft thread insertion air nozzle would also be constructed accordingly for handling two, three, or four multi-ply yarns. In both embodiments the strand guide and sensor elements 5 would be arranged upstream of the plying and storage device 2 rather than downstream thereof because this is necessary to monitor each strand individually. Arrangement of the elements 5 downstream of the device 2 would not satisfy this requirement because it would not ascertain whether the weft thread contains all the required strands.

Advantages of the invention are seen in that a plying apparatus outside of the loom has been obviated. Thus, the costs for the apparatus investment have been reduced. Error sources have been eliminated and the entire structure has been simplified. Moreover, due to the arrangement of the strand guide and sensor elements 5 directly between the supply 6 and the plying and storage device 2, it is made sure that the multi-ply yarn 3 contains the required number of strands.

Further, the arrangement is substantially more flexible than conventional systems in which the plying mechanism is a separate unit because in the system according to the invention large or small quantities of fabrics may be made without regard to the efficient use of the plying device 2. On the other hand, in conventional systems, the separate operation of the plying apparatus usually calls for producing large quantities of multi-ply yarn to the make the operation of the separate plying apparatus efficient. The invention also eliminates the transport of the multi-ply yarn from the separate plying apparatus to the loom.

Another advantage of the invention is seen in that it produces the multi-ply yarn substantially in a "as you need it" manner so that the storage capacity of the device 2 can be relatively small compared to the large volume spools or bobbins required for a conventional plying apparatus. Due to the multiple strand or plies that must be wound up in a conventional plying machine, the required bobbins or coils are large volume coils. Nevertheless, they can only carry a relative short multi-ply yarn length. The invention avoids this problem as well. This is so because the supply bobbins or spools 6 can be relatively small, yet are able to carry substantial length of strands because single strands are involved. This is an important advantage of the invention because it greatly reduces the number of times that the operator must perform a tying operation. The longer the individual threads, the fewer will be the required ties or knots.

Although the invention has been described with reference to specific example embodiments, it will be appreciated that it is intended to cover all modifications and equivalents within the scope of the appended claims.

What we claim is:

1. An air nozzle loom, comprising weft thread insertion air nozzle means, strand plying and weft thread storing means for plying a plurality of weft thread strands into at least one multi-ply weft thread directly in said air nozzle loom and for storing a length of multi-ply weft thread, a plurality of weft thread strand supply spools for supplying the individual weft thread strands to said plying and storing means, the yarn receiving opening of said weft thread insertion air nozzle means being positioned adjacent to and facing said plying and storing means on a weft thread insertion side of said air nozzle loom for directly receiving multi-ply weft thread from said plying and storing means and to insert a multi-ply weft thread into a loom shed, said strand plying and storing means being operatively located between said strand supply spools and said air nozzle means, said length of multi-ply weft thread being sufficient to provide a smooth supply of weft thread to said air nozzle means throughout an insertion period.

2. The air nozzle loom of claim 1, further comprising thread guide sensors located between said strand supply spools and said strand plying and storage means for guiding said strands individually into said strand plying and storage means and to provide a loom control signal in response to a strand defect for stopping said loom in response to such a defect in any one of said plurality of strands.

3. The apparatus of claim 1, wherein said strand supply spools carry twisted strands.

* * * * *